US006665932B2

(12) United States Patent
Saito

(10) Patent No.: US 6,665,932 B2
(45) Date of Patent: Dec. 23, 2003

(54) SMT CONNECTOR AND METHOD OF PRODUCTION OF SAME

(75) Inventor: Nobuo Saito, Tokyo (JP)

(73) Assignee: Nagano Fujitsu Component, Nagano (JP)

( * ) Notice: Subject to any disclaimer, the term of this patent is extended or adjusted under 35 U.S.C. 154(b) by 0 days.

(21) Appl. No.: 10/013,710

(22) Filed: Dec. 13, 2001

(65) Prior Publication Data

US 2002/0173180 A1 Nov. 21, 2002

(30) Foreign Application Priority Data

May 21, 2001 (JP) ..... 2001-151236

(51) Int. Cl.[7] ..... H01R 93/02

(52) U.S. Cl. ..... 29/879; 29/874; 29/882; 29/883

(58) Field of Search ..... 29/883, 884, 876, 29/874, 879, 882

(56) References Cited

U.S. PATENT DOCUMENTS 4,445,736 A * 5/1984 Hopkins
4,541,174 A * 9/1985 Liburdi
4,593,463 A * 6/1986 Kamono
4,817,283 A * 4/1989 Johnson et al.
5,074,039 A * 12/1991 Hillbish et al.
5,425,172 A * 6/1995 Carswell et al.
6,059,601 A * 5/2000 Hirai et al.
6,217,393 B1 * 4/2001 Muta
6,370,771 B1 * 4/2002 Huang

* cited by examiner

*Primary Examiner*—Carl J. Arbes
(74) *Attorney, Agent, or Firm*—Staas & Halsey LLP

(57) ABSTRACT

An SMT connector suitable for surface mounting on a printed circuit board enabling the necessary coplanarity to be secured even if not providing a coplanarity correction step after assembly, wherein contact members made of a metal having a high hardness have lead members made of a metal having a low hardness and shaped straight connected to them, the connection parts are covered by an insulating material, next, the lead members are bent in a crank shape, whereby the coplanarity of the lead members is maintained at within a predetermined accuracy, and a method of production of the same.

8 Claims, 8 Drawing Sheets

SIDE VIEW

FRONT VIEW

SMT CONNECTOR AND METHOD OF PRODUCTION OF SAME

BACKGROUND OF THE INVENTION

1. Field of the Invention

The present invention relates to a connector and a method of production of the same, more particularly relates to an SMT connector suitable for surface mounting on a printed circuit board and a method of production of the same.

2. Description of the Related Art

Use of an SMT connector which is surface mounted on a printed circuit board for connection with external circuits has become general practice due to the increasingly smaller size and lighter weight of printed circuit boards in recent years.

FIGS. 1A to 1C are perspective views of a conventional SMT connector, wherein FIG. 1A is a perspective view of an overall connector, FIG. 1B a conductor before processing, and FIG. 1C a conductor after processing, wherein a lead 102 of a single conductor 10 formed with a contact 101 at its front end and formed with a lead 102 at its rear end is bent in a crank shape.

The connector is produced by arranging a required number of bent conductors and encasing them by an insulating material or press-fitting processed conductors into an insulator.

Summarizing the problems to be solved by the invention, in an SMT connector produced by the above method, however, the problem arises of a deterioration of the coplanarity.

FIGS. 2A and 2B are explanatory views of problems arising in a conventional connector. The coplanarity of the leads deteriorates due to the following two reasons:

1. As shown by FIG. 2A the coplanarity of the leads deteriorates due to deformation (twisting, warping) of the insulator itself after encasing the conductors or press-fitting the conductors.
2. As shown by FIG. 2B, the coplanarity of the leads deteriorates due to the variability of the press-forming accuracy of the leads.

Therefore, it was necessary to provide a step of correcting the coplanarity after finishing assembly of the SMT connector so as to improve the coplanarity.

BRIEF DESCRIPTION OF THE DRAWINGS

These and other objects and features of the present invention will become clearer from the following description of the preferred embodiments given with reference to the attached drawings, wherein.

SUMMARY OF THE INVENTION

An object of the present invention is to provide an SMT connector suitable for surface mounting on a printed circuit board enabling the necessary coplanarity to be secured even without providing a coplanarity correction step after assembly and a method for production of the same.

An SMT connector according to a first aspect of the present invention is comprised of a contact member made of a metal having a high hardness, a lead member of a crank shape having one end connected to one end of the contact member and made of a metal having a low hardness, and an insulating material covering a connection part of the contact member and the lead member.

An SMT connector according to the present invention is structured of a contact member having a high hardness and a lead member having a low hardness connected together and having a connection part covered by an insulating material.

A method of production of an SMT connector according to a second aspect of the invention is comprised of a connecting step of connecting one end of a contact member and one end of a straight-shaped lead member, a covering step of covering the connection part of the contact member and lead member connected in the connecting step by an insulating material, and a bending step of bending the lead member after covering in the covering step.

In the present invention, a contact member having a high hardness and a straight-shaped lead member having a low hardness are connected, the connection part is encased, and finally the lead is bent into a crank shape.

DESCRIPTION OF THE PREFERRED EMBODIMENTS

Preferred embodiments of the present invention will be described in detail below while referring to the attached figures.

Figure 1A:
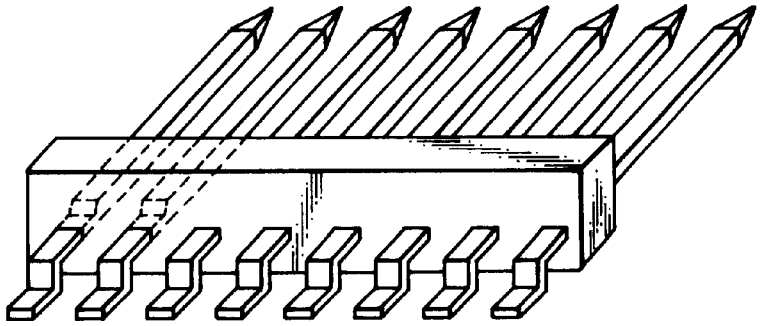
FIGS. 1A to 1C are perspective views of a conventional SMT connector.
Figure 1B:
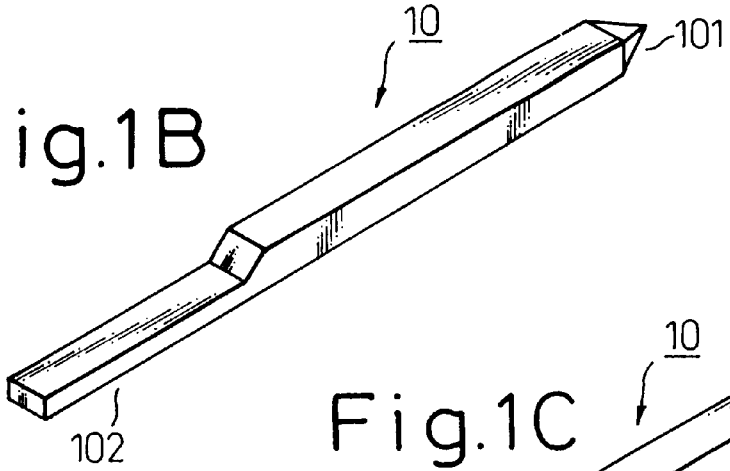
Figure 1C:
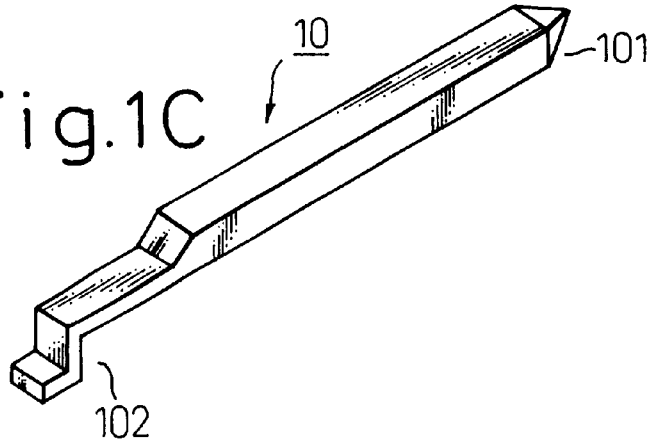
Figure 2A:
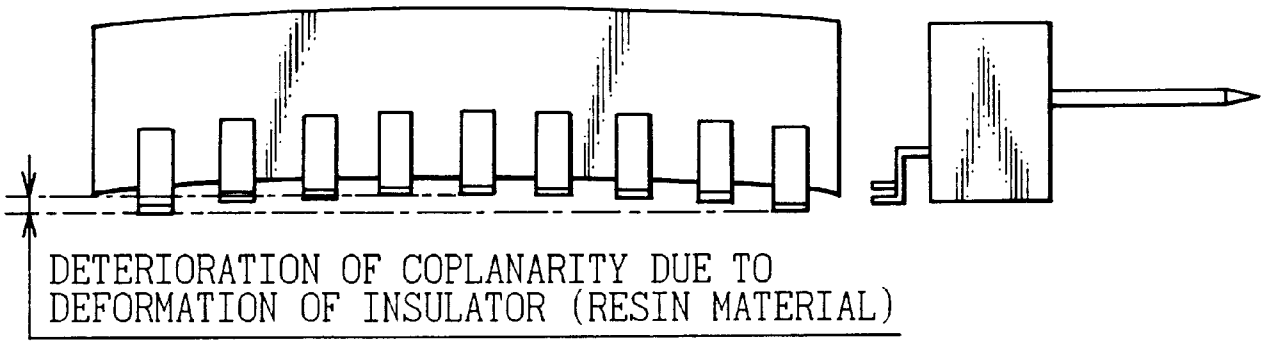
FIGS. 2A and 2B are explanatory views of problems occurring in a conventional SMT connector.
Figure 2B:
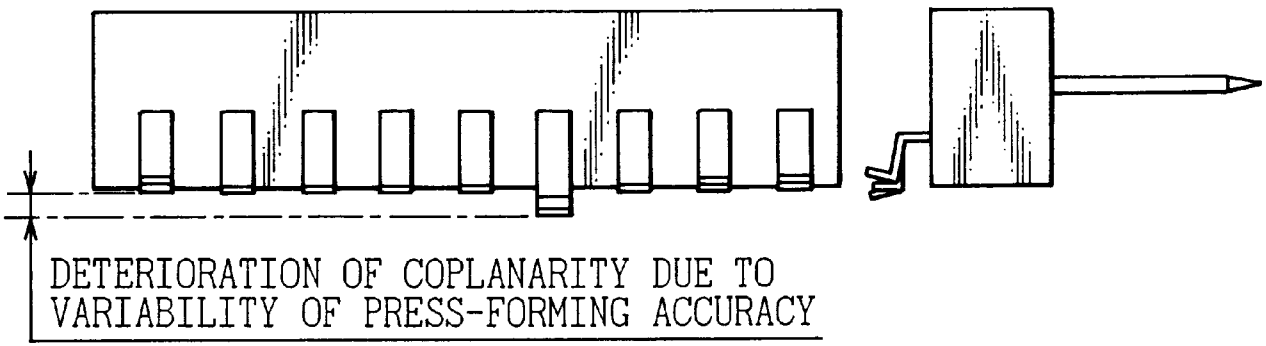
Figure 3A:
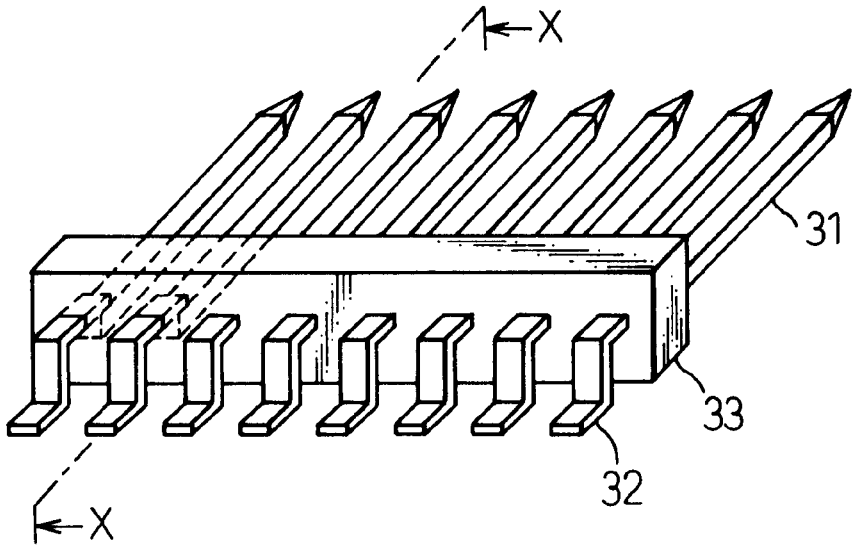
FIGS. 3A and 3B are structural views of an SMT connector according to the present invention.
Figure 3B:
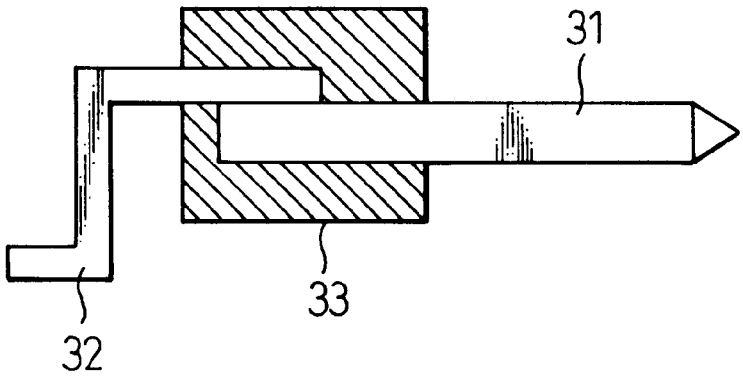

FIGS. 3A and 3B are structural views of an SMT connector according to the present invention, wherein FIG. 3A is a perspective view and FIG. 3B is a sectional view along the line X—X.

That is, the SMT connector according to the present invention is structured of contact members 31 produced by a material having a high hardness (for example, brass or phosphor bronze) and lead members 32 produced by a material having a low hardness (for example, copper) electrically connected inside an insulating material 33.

Figure 4:
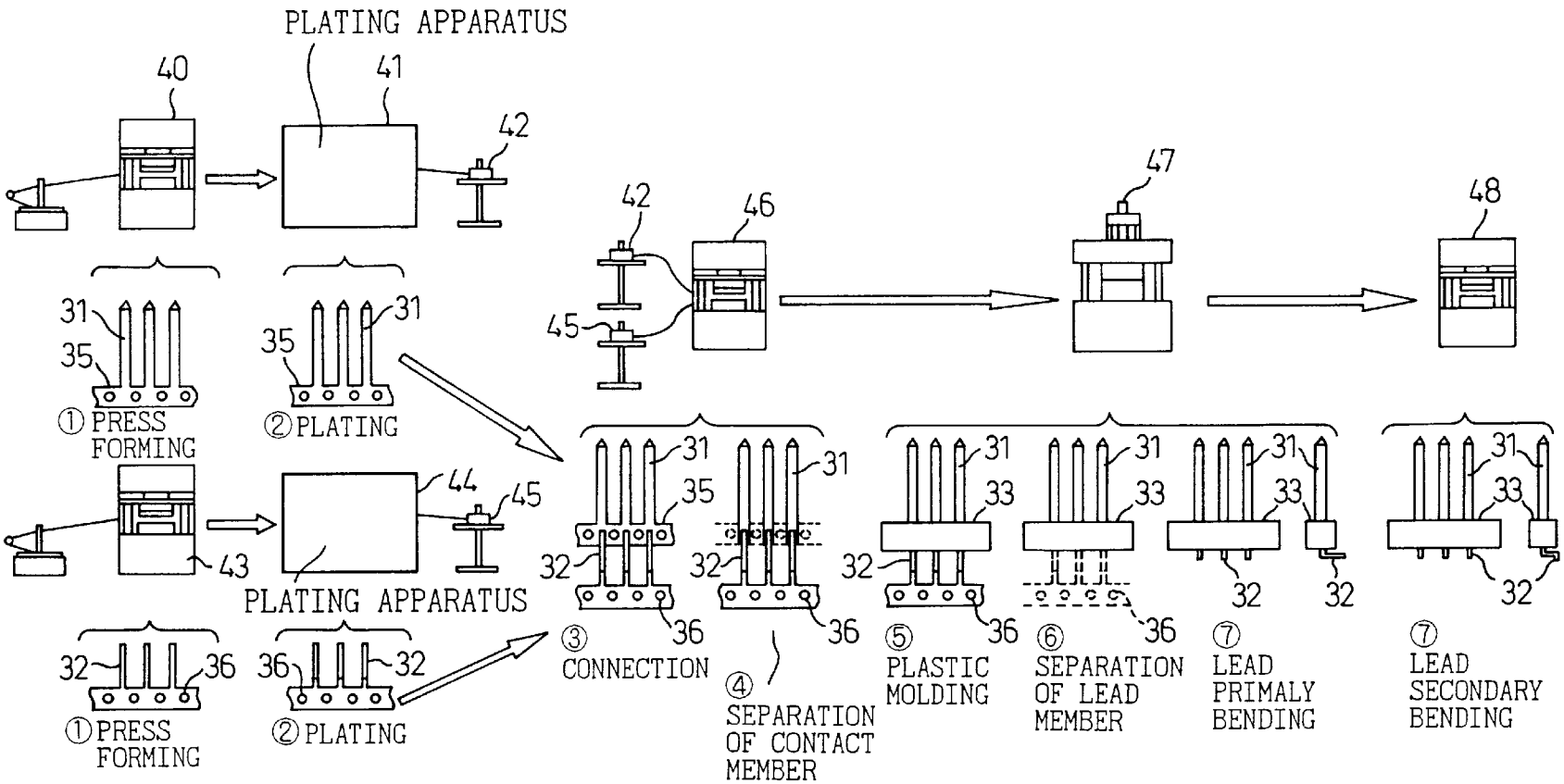
FIG. 4 is an explanatory view of a first method of production of an SMT connector.

FIG. 4 is an explanatory view of a first method of production of an SMT connector according to the present invention. Contact members 31 are press-formed from a metal material by a contact member press 40. The contact members 31 are formed at equal intervals on a band-shaped contact member carrier 35 so as to enable easy subsequent handling.

The contact members 31 are plated in a contact member plating apparatus 41 along with the contact member carrier 35 and taken up on a contact member reel 42.

Lead members 32 are press-formed from a metal material by a lead member press 43. The lead members 32 are formed at equal intervals on a band shaped lead member carrier 36 so as to enable easy subsequent handling.

The lead members 32 are plated in a lead member plating apparatus 44 along with the lead member carrier 35 and taken up on a lead member reel 42.

A connecting machine 46 receives the supply of the contact members 31 from the contact member reel 42 and the lead members 32 from the lead member reel 45 and connects the contact members 31 and lead members 32. The method of connection is not particularly limited, but welding or crimping is suitable.

Further, after connection is finished, the contact member carrier 35 is removed to separate the contact members 31.

The plastic molding machine 47 covers the connection parts of predetermined numbers of contact members 31 and lead members 32 by an insulating material. Next, the lead member carrier 36 is removed to separate the lead members 32 and primary bending is performed to bend the lead members 32 perpendicularly downward.

Finally, the secondary bending machine 48 performs secondary bending for bending the front ends of the lead members 32 perpendicularly horizontally.

Figure 5:
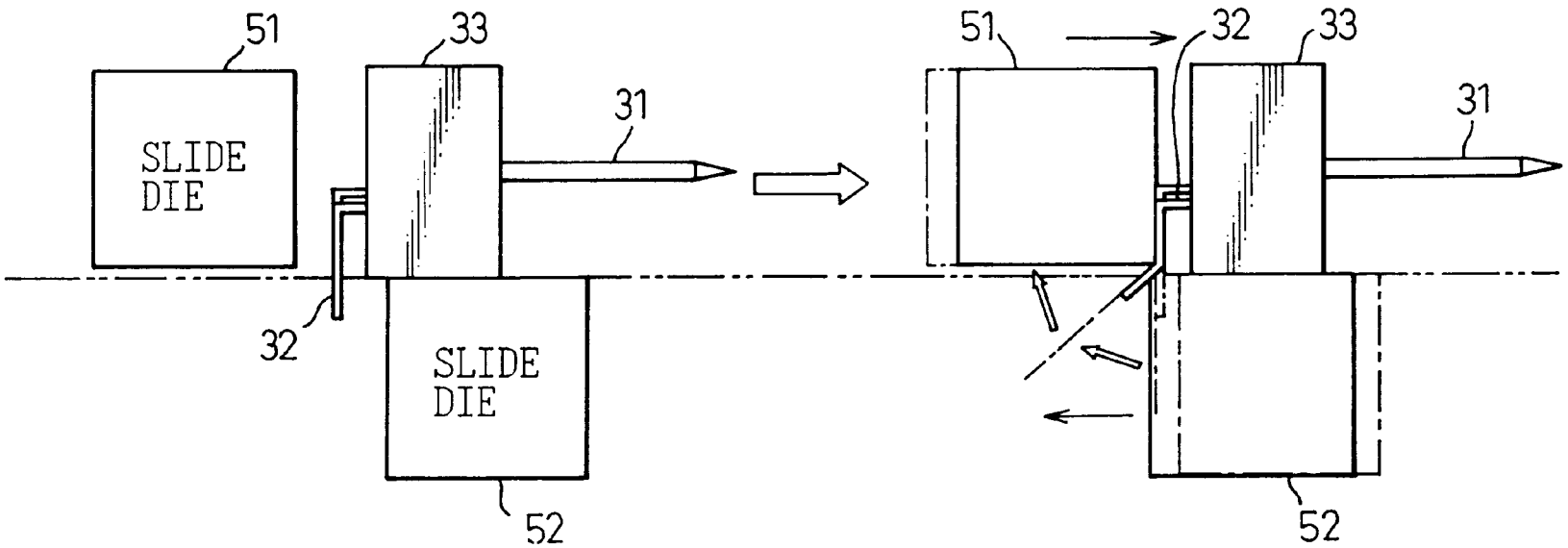
FIG. 5 is an explanatory view of a first secondary bending method.

FIG. 5 is an explanatory view of a first secondary bending method. The SMT connector after the primary bending is placed on a bed on the top and bottom surfaces of which two slide dies 51 and 52 slide.

That is, when the SMT connector after the primary bending is placed on the bed, the lead members 32 extend to the bottom from the surface of placement.

The top surface slider 51 is slid to the back surface of the lead members 32, then the bottom surface slider 52 is slid so as to bend the front ends of the lead members 32 along the bottom surface of the top surface slider and thereby complete the secondary bending of the lead members 32.

Figure 6:
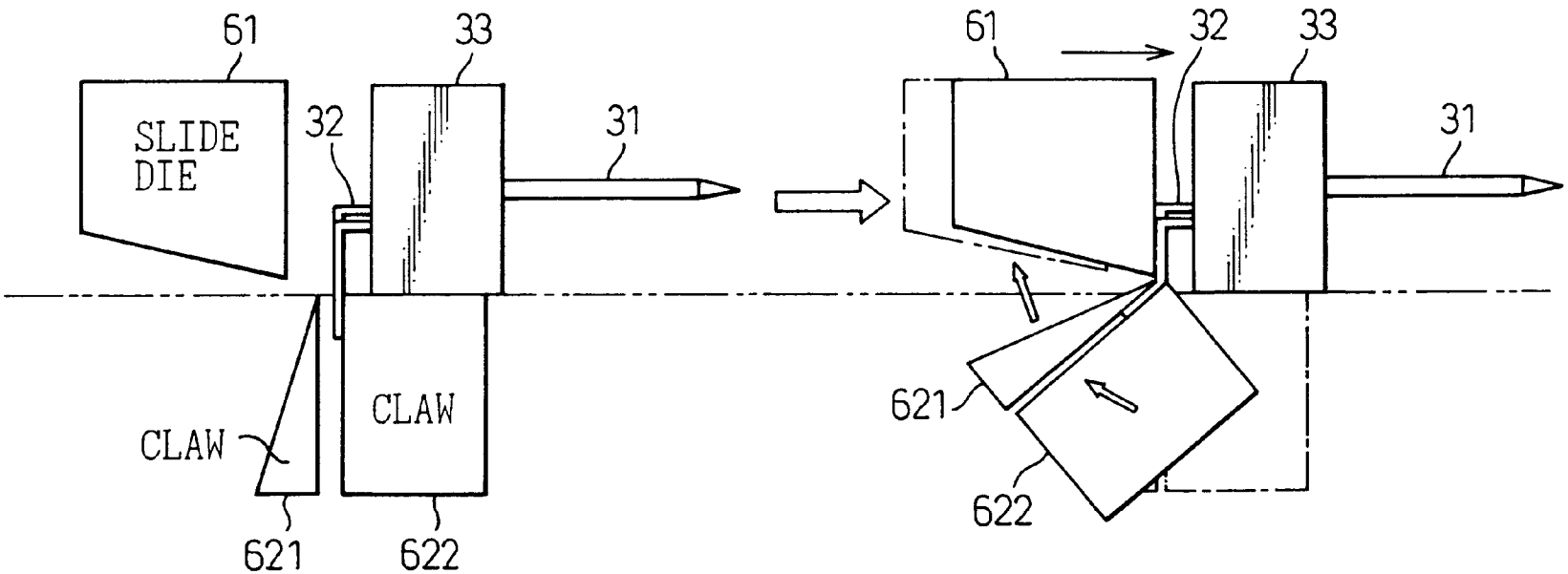
FIG. 6 is an explanatory view of a second secondary bending method.

FIG. 6 is an explanatory view of a second secondary bending method. A damper comprised of a slide die 61 and a pair of claws 621 and 622 is provided.

The cross-section of the slide die 61 is frustoconical in shape. The sectional shape becomes substantially rectangular when combined with one claw 621 of the damper having an acute angle triangular cross-sectional shape. Note that the sectional shape of the other claw 622 of the damper is rectangular.

In the same way as the first secondary bending method, when the SMT connector after the primary bending is placed on the bed, the lead members 32 extend to the bottom from the surface of placement.

The downward extending lead members 32 are clamped by the claws 621 and 622. In that state, the damper is rotated until one claw 621 of the damper strikes the slide die 61, whereby the secondary bending of the lead members is completed.

Figure 7:
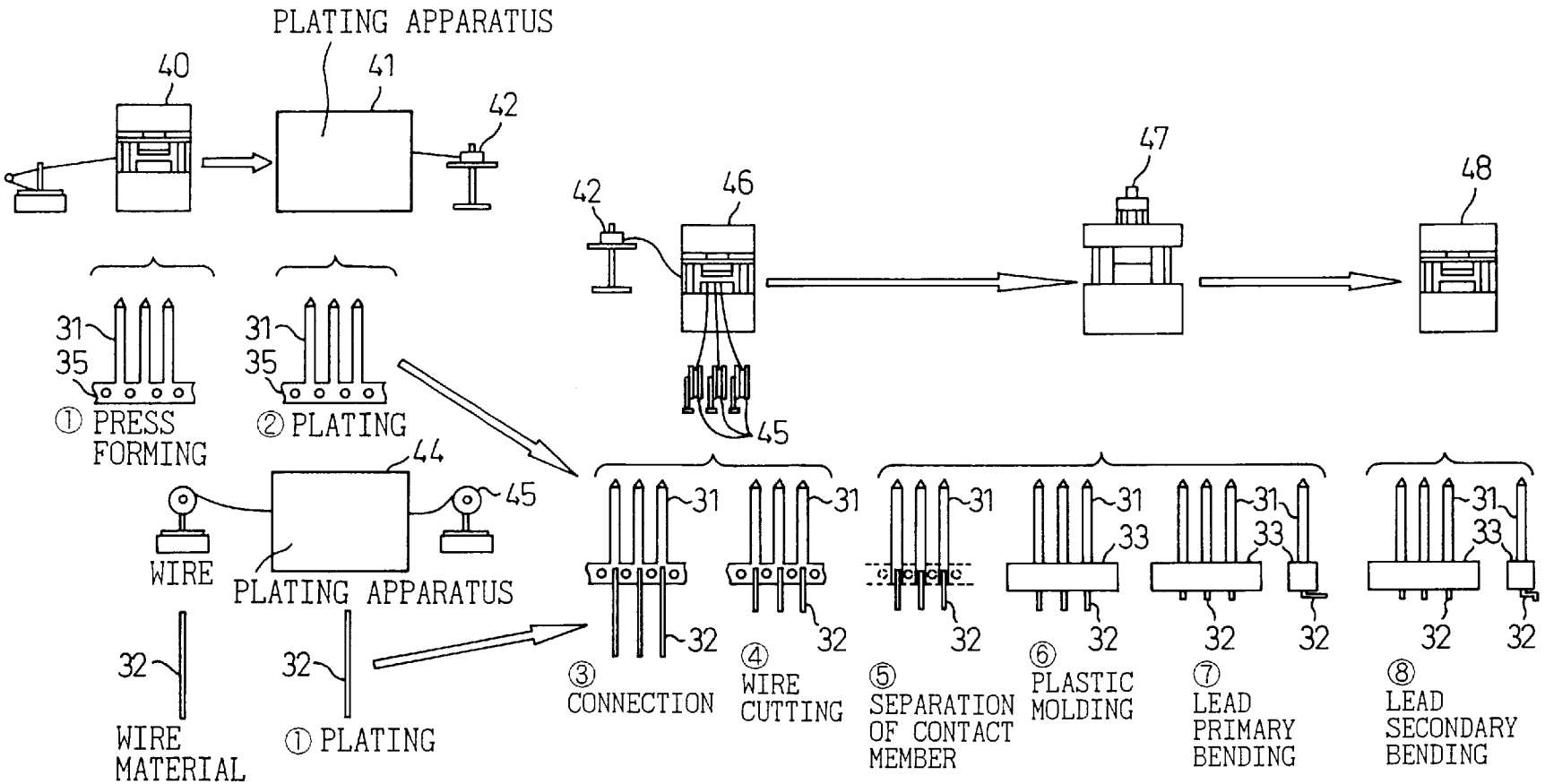
FIG. 7 is an explanatory view of a second method of production of an SMT connector.

FIG. 7 is an explanatory view of a second method of production of an SMT connector according to the present invention. The lead members 32 are produced by plating wires by a lead member plating apparatus 44.

In the connecting machine 46, wire-shaped lead members 32 are connected to the contact members 31 attached to the contact member carrier 35, then the lead members 32 are cut to predetermined lengths.

Next, in the plastic molding machine 47, first the contact member carrier 35 is removed to separate the contact members 31, then the connection parts of the contact members 31 and lead members 32 are encased by a resin.

The rest of the production process is identical to the first method of production.

Figure 8:
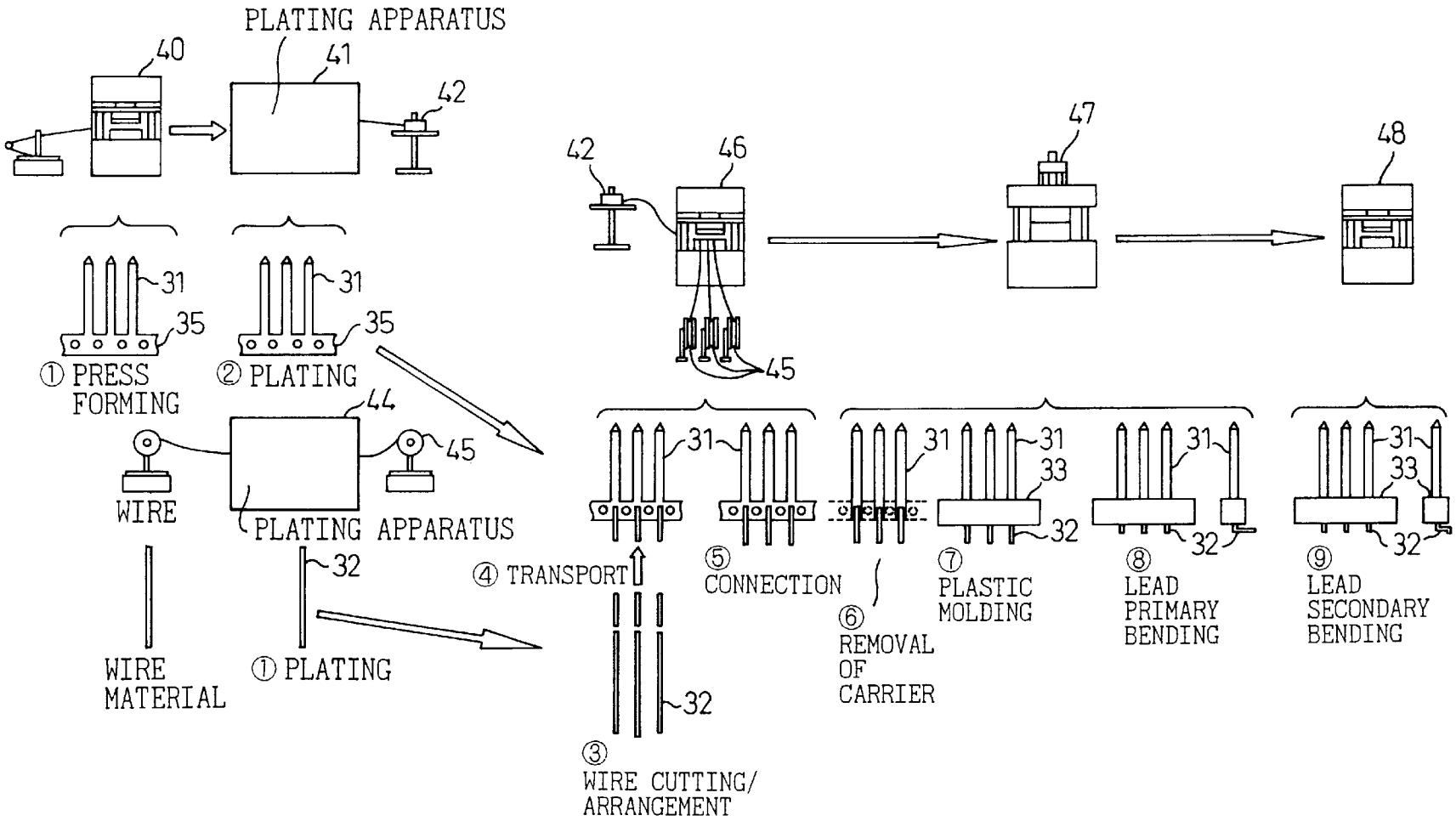
FIG. 8 is an explanatory view of a third method of production of an SMT connector.

FIG. 8 is an explanatory view of a third method of production of an SMT connector according to the present invention. In the same way as the second method of production, the lead members 32 are wire shaped.

In the connecting machine 46, unlike the explanatory view of the second method of production, first the wire-shaped lead members 32 are cut to predetermined lengths, then are connected to the contact members.

The rest of the production process is identical to the second method of production.

Summarizing the effects of the invention, according to the present invention, since the SMT connector is produced by connecting contact members having a high hardness and lead members having a low hardness, covering the connection parts by an insulating material, and bending the lead members into a crank shape, it becomes possible to maintain the required coplanarity of the lead members even without proving a correction step.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2001-151236, filed on May 21, 2001, the disclosure of which is expressly incorporated herein by reference in its entirety.

What is claimed is:

1. A method of production of an SMT connector, comprising:

connecting one end of each of a plurality of contact members having a high hardness and one end of each of a plurality of straight-shaped lead members having a low hardness;

covering the connected parts with an insulating material; and bending lead members after covering so as to maintain a coplanarity of said lead members.

2. A method of production of an SMT connector as set forth in claim 1, wherein said connecting connects said contact members and said lead members produced by press-forming.

3. A method of production of an SMT connector as set forth in claim 1, wherein said connecting connects said contact members produced by press-forming and wire-shaped lead members.

4. A method of production of an SMT connector as set forth in claim 1, wherein said bending comprises:

bending base ends of the lead members; and bending further front ends of the lead members.

5. A method of production of an SMT connector as set forth in claim 4, wherein said bending further comprises:

sliding a first slide die to abut against the lead members bent at their base ends, and sliding a second slide die along a bottom surface of said first slide die so as to bend the front ends of the lead members.

6. A method of production of an SMT connector as set forth in claim 4, wherein said bending further comprises:

sliding a slide die to abut against the lead members bent at their base ends [at said primary bending step], clamping front ends of the lead members by a clamper, and rotating the clamper until the clamper abuts against the slide die so as to bend the front ends of clamped lead members.

7. A method of production of an SMT connector as set forth in claim 2, wherein said bending comprises:

bending base ends of the lead members, and bending further front ends of the lead members bent at their base ends.

8. A method of production of an SMT connector as set forth claim 3, wherein said bending comprises:

bending base ends of the lead members, and bending further front ends of the lead members bent at their base ends.

* * * * *

UNITED STATES PATENT AND TRADEMARK OFFICE

CERTIFICATE OF CORRECTION

PATENT NO. : 6,665,932 B2
DATED : December 23, 2003
INVENTOR(S) : Nobuo SAITO

It is certified that error appears in the above-identified patent and that said Letters Patent is hereby corrected as shown below:

Column 4,
Line 50, delete "[at said primary bending step]".

Signed and Sealed this

Eighth Day of June, 2004

JON W. DUDAS
*Acting Director of the United States Patent and Trademark Office*